United States Patent [19]

Bergler

[11] Patent Number: 4,572,259

[45] Date of Patent: Feb. 25, 1986

[54] PLANING TOOL AND CUTTER THEREFOR

[75] Inventor: Otto Bergler, Mühlacker-Lomersheim, Fed. Rep. of Germany

[73] Assignee: Black & Decker Overseas AG, Vaduz, Liechtenstein

[21] Appl. No.: 609,127

[22] Filed: May 11, 1984

[30] Foreign Application Priority Data

May 24, 1983 [DE] Fed. Rep. of Germany ..... 3318799
May 24, 1983 [DE] Fed. Rep. of Germany ..... 3318820

[51] Int. Cl.[4] ..... B27G 13/00
[52] U.S. Cl. ..... 144/230
[58] Field of Search ..... 144/230; 145/17, 14

[56] References Cited

U.S. PATENT DOCUMENTS

| | | | |
|---|---|---|---|
| 203,442 | 5/1878 | Griffin | 145/14 |
| 552,435 | 12/1895 | Hass | 145/17 |
| 920,549 | 5/1909 | Dette | 144/230 |
| 1,013,540 | 1/1912 | Faucette | 144/230 |
| 1,021,202 | 3/1912 | Marsh | 144/230 |
| 1,026,053 | 5/1912 | Saner | 145/17 |
| 1,150,677 | 8/1915 | Harrold | 144/230 |
| 1,629,760 | 5/1927 | Wolf | 144/230 |
| 2,710,635 | 6/1955 | Alexander | 144/230 |
| 4,347,882 | 9/1982 | Bachmann . | |

FOREIGN PATENT DOCUMENTS

| | | | |
|---|---|---|---|
| 172912 | 7/1906 | Fed. Rep. of Germany . | |
| 3102065 | 2/1982 | Fed. Rep. of Germany . | |
| 368930 | 11/1982 | Fed. Rep. of Germany . | |
| 807398 | 10/1936 | France | 145/14 |
| 131434 | 4/1951 | Sweden | 145/14 |
| 320043 | 4/1957 | Switzerland | 144/230 |

*Primary Examiner*—Frederick R. Schmidt
*Assistant Examiner*—J. T. Zatarga
*Attorney, Agent, or Firm*—Burns, Doane, Swecker & Mathis

[57] ABSTRACT

A plurality of planer cutters are mounted on a center piece of a planer tool. A clamping flap and mounting bolts connect the cutter to the center piece. The cutter has a groove adapted to receive the collars of adjusting screws to radially adjust the cutter. The flap is connected to the center piece at two circumferentially spaced locations so that a long flap can be employed which is shaped complementarily to the shape of the cutter profile.

10 Claims, 5 Drawing Figures

PLANING TOOL AND CUTTER THEREFOR

BACKGROUND AND OBJECTS OF THE INVENTION

The invention relates to a planing tool with at least two cutter blades attached symmetrically about a rotary axis to a center piece by means of a flap, the flaps being clamped by mounting bolts against the center piece.

Planing tools of this type are known in the form of flap shafts. The flaps comprise segments separate from a center piece of the tool. The flaps are held fixedly against the center piece by means of mounting bolts so as to clamp the planer cutters between themselves and the center piece. Similar configurations are also known for planer heads which are merely shorter in the axial direction than the shafts.

A disadvantage of such known planing tools relates to the fact that only tools or cutters may be clamped which project by a maximum of approximately 1 mm in circumference past the circle of rotation of the planer body. In particular, because of the risk of accidents, the projection of the tool from the body is specified by safety standards for all tools to which the workpiece is fed by hand.

It is known from DE-OS No. 31 02 065 to provide profiled planer cutters in the case of the so-called wedge shafts; they are combined with fenders so that the cutter edge will not project more than approximately 1 mm. A disadvantage is that the fenders are able to seize the fingers of the operator.

It is an object of the present invention to provide a safer planer head or tool which is optimally suited in particular to profile work.

SUMMARY OF THE INVENTION

In the present invention each flap extends circumferentially from a proximate end thereof adjacent the associated cutter to a remote end thereof adjacent the cutting edge of the next cutter. The flap is positively held to the center piece by a mounting bolt and by shoulder means adjacent the remote end. This arrangement makes it possible to provide each planer cutter with a flap of a certain shape, so that the entire circumference of the planing tool is adapted to the profile to be processed, to facilitate safety and avoid the need for using separate planer heads. The flaps are thus held in the planing tool positively in two locations and may thus be arranged over a circumferential area that is much longer than in the case of the previously known flaps. The combination of positive fastening with the known bolt attachment leads, in spite of the easy exchangeability of the cutters and the flaps, to a stable joining of the parts of the novel planing tool. As the result of this configuration, the tools may be employed not only for processing shallow depths of the extent known heretofore but also in profile work that has not been possible with such tools in the past. The invention makes it possible to adjust the clamping flaps in each case to the circle of rotation of the associated tool. The remote end of the flaps may define part of the chip ejection groove, so the flaps and cutters may be replaced together with the necessary tool on the planer head. It is, therefore, possible by means of the novel planing tool to effect a series of planing processes which heretofore could be performed only with special machines and not on the site of installation.

The positive joint between the flap and the center piece may be obtained in an especially simple manner by each flap provided with a fastening lip to grip a shoulder of the center piece. The fastening lip may be in the form of an enlargement which is inserted axially into a groove located behind the shoulder. The novel flap is thus pushed axially onto the center piece and is seated after fastening by means of the associated mounting bolts in a safe and stable manner on the center piece.

It is advantageous to equip the flap with a steel plate which also may cover the outer surface of the flap facing the cutter. It is then possible to make the center piece of the planing tool and the flap of a light metal, for example, aluminum or an aluminum alloy, without the clamping surface becoming excessively soft and exposed to damage in use. The steel plate is very easily worked together with the aluminum or another material and may be inserted for example during casting, together with the flap.

It is an advantage to provide at least two bores in the flap, extending approximately perpendicularly to the bore for the fastening tool, whereby the adjusting screws may be actuated for the radial adjustment of the planer cutters.

The invention further concerns a plane cutter, in particular, a profile cutter for the afore-mentioned rotating planer heads or the like, which may be pressed by means of a clamping flap and by fastening bolts extending through orifices in the cutter and adjusted perpendicularly to the mounting bolts by means of adjusting screws.

The adjustment of the diameter of the rotating circle of such cutters usually is effected from the side of the cutter edge, so that it is possible to ascertain the alignment of the cutter installed simultaneously with the adjustment.

A planer cutter of the afore-mentioned type should have a configuration such that in particular in the case of easily removable planer heads of the above-described type, adjustments may be effected simply. For this purpose, on the side of the cutter facing away from the cutting edge of the orifices for the mounting bolts, a groove extends parallel to the plane wherein the center axes of the orifices are located. The groove is engaged by collars of the adjusting screws, which collars are constrained to move longitudinally with the adjusting screws. It is possible in this manner to place collars that are rotating and are entrained by the motion of the adjusting screws in the area of the foot of the cutter. The adjusting screws themselves may then be actuated in a simple manner also from the side of the planer head facing away from the cutter edges, through the corresponding orifices.

The novel cutter providing this advantageous mode of adjustment has the further advantage that it experiences no weakening in the area of the edge and the adjacent clamping location by an adjusting groove or other openings. The clamping locations of the planer head are also unaffected by the arrangement of bores or guides and may be laid out exclusively for their clamping effect. It is advantageous to place the groove on the side wall of the cutter, so that the collar of the adjusting screws may act on the cutter from the inner side of the planer head, where there is more space for the location of the adjusting screws. Finally, the groove extends continuously over the length of the cutter which is then inserted simply from the frontal side of the planer head, wherein the groove, preferably provided with a rectangular cross-section, is pushed axially over the corresponding collar. The novel cutters are easily manufactured in view of this configuration. In particular, in the area of the cutter edge to be hardened, both a smooth, continuous breast and a corresponding back of the cutter are provided. The novel cutter is especially suitable for special planer heads, as described hereinbelow.

THE DRAWING

The objects and advantages of the invention will become apparent from the following detailed description of preferred embodiments thereof in connection with the accompanying drawings in which like numerals designate like elements, and in which.

DETAILED DESCRIPTION OF PREFERRED EMBODIMENTS OF THE INVENTION

Figure 1:
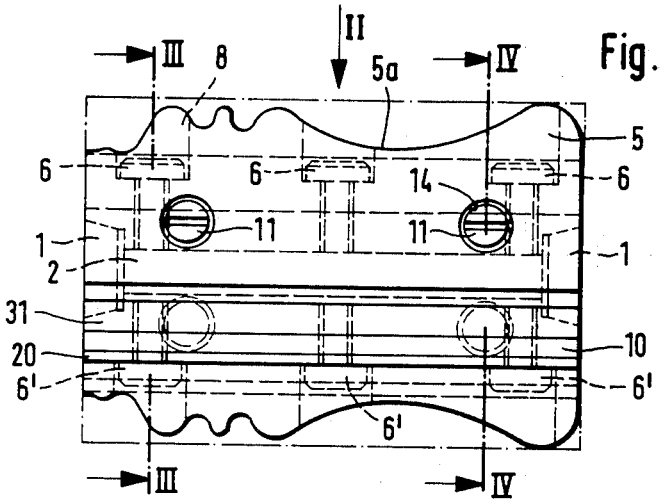
FIG. 1 is an elevational view of a planer head according to the invention with the profile cutters and the associated clamping flaps installed.
Figure 2:
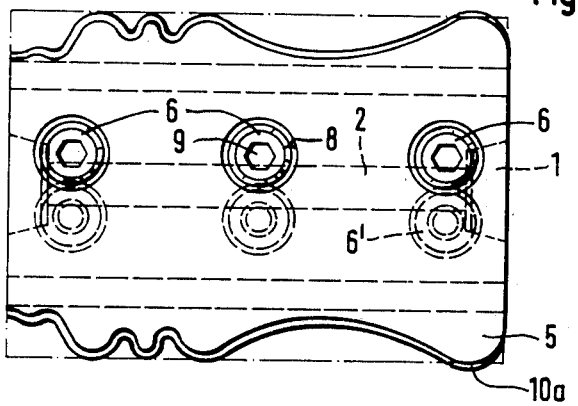
FIG. 2 is a side view of the planer head of FIG. 1 taken in the direction of the arrow II of FIG. 1.
Figure 3:
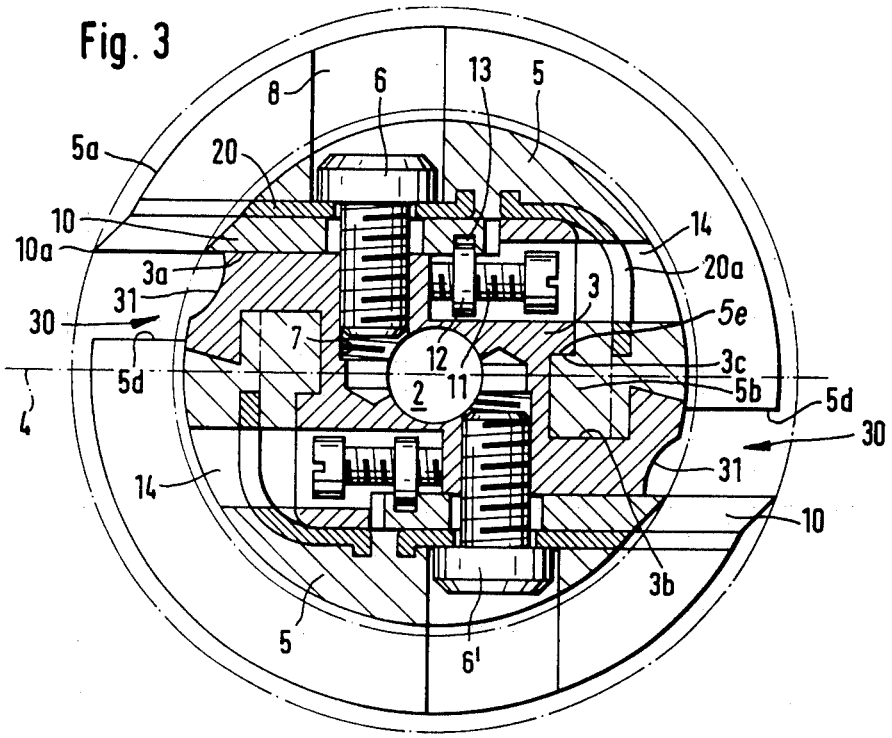
FIG. 3 is a cross-sectional view taken along lines III—III in FIG. 1.

FIGS. 1 to 3 show a planing head or tool in the form of a rotational body which may be inserted preferably in a hand-held plane driven by an electric motor. This is effected by placing the planing tool such that centering recesses 1 (indicated by broken lines in FIGS. 1 and 2) provided on the frontal sides thereof receive corresponding centering pegs of the manual plane (not shown). A floating shaft would be passed through a continuous bore 2 and joined to a drive motor.

The planing tool of FIGS. 1 to 3 comprises a center piece 3 having a throughbore 2, to which two clamping flaps 5 are attached. The flaps 5 are arranged in a symmetrical manner with respect to the longitudinal center plane 4 and are fixedly connected with the center piece 3 by means of two sets 6, 6' of three mounting bolts. The mounting bolts 6 engage internal threads 7 in the center piece 3. The clamping flaps 5 are preferably provided with circular recesses 8, through which an internal hexagon 9 of the mounting bolts 6 is accessible to be tightened and released.

Each of the clamping flaps 5 (which in the disclosed embodiment has a profiled outer contour 5*a*) presses a profile cutter 10 tightly against an abutting surface 3*a* of the center piece 3, which is extending perpendicularly to the axial direction of the mounting bolts 6. The bolts 6, 6' pass through slots 10*b* in the cutters 10. The contour of the profile cutter 10 corresponds to the outer contour 5*a* of the clamping flaps 5, but the cutters always project slightly beyond the diameter of the circle of rotation of the clamping flap 5, as seen in FIG. 3. In the center piece 3, an adjusting thread is provided for receiving pairs of adjusting screws 11. The screws have collars 12 which each engage a groove 13 of the profile cutter 10, and are accessible from the outside through a recess 14 for adjusting purposes. With their aid, the radial position of the profile cutters 10 may be set relative to the center piece, provided that the clamping flaps 5 have not been tightened.

Each clamping flap extends from a proximate end thereof adjacent the associated cutter 10 along approximately one-half of the circumference of the planing tool, to a clamping recess 30 provided for the next plane cutter. A remote end face 5*d* of the flap which faces that clamping recess 30 forms a part of a chip ejection groove, the bottom whereof is formed by a recess 31 in the center piece 3. At this remote end, remote from the mounting bolt 6, each clamping flap 5 is seated positively on the center piece 3. In the preferred embodiment this is effected by means of a mounting enlargement 5*b* of the flap which engages a groove 3*b* in the center piece 3, in such manner that a fastening shoulder or ridge 3*c* on the center piece 3 is hooked by a lip or shoulder 5*e* on the enlargement 5*b*. The flap 5 is inserted into the groove 3*b* in a direction parallel to the axis of rotation of the tool; insertion in a radial plane is prevented. The mounting enlargement 5*b* is installed into the groove 3*b* of the center piece 3 prior to the application of the mounting bolts 6. Following the subsequent insertion of the associated profile cutter 10, the mounting bolts 6 are inserted. Prior to the bolt being tightened, the fine setting of the profile cutter 10 is effected by means of the adjusting screws 11, two of which are provided in the preferred embodiment. After the tightening of the mounting bolts 6, the clamping flaps 5 and the profile cutters 10 are seated fixedly and accurately on the center piece 3. Thus, by means of screw fastening along a longitudinal plane in this manner, a rapid and stable attachment of a clamping flap may be obtained, with the flap forming approximately one-half of the circumference of the entire planing tool.

Each clamping flap 5 carries a steel plate 20 which is positioned to bear against the associated cutter 10. The plate 20 can be molded to the flap.

It is an advantage of this configuration of the planing tool that profiling work can be performed without endangering the operator, as the circumference of the tool is adapted in shape to the profile cutters used. In spite of this rapid attachment, conversion to other types of profile cutters is possible. For this purpose it is merely necessary to insert the appropriate profile cutters and the new clamping flaps adapted to them.

Figure 4:
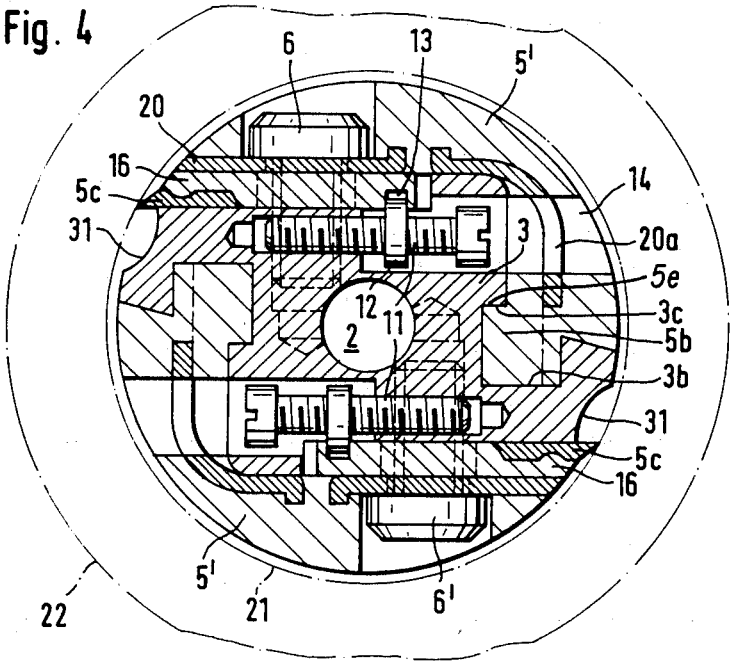
FIG. 4 is a cross-sectional view taken along the line IV—IV in FIG. 1, but with standard planer cutters inserted in place of the profile cutters.

As seen in FIG. 4, it is possible to employ clamping flaps 5' which are not profiled. With the aid of these clamping flaps 5', conventional reversible planer cutters may be held, which are guided in a known manner by special guide plates 16 on the center piece 3; they may be adjusted by means of the adjusting screws 11. The anchoring and fastening of the clamping flaps 5' is achieved in the manner described in connection with FIGS. 1 to 3. Thus, with a single center piece, that is joined for rotation with the drive of a manual plane, different planing tools may be realized by replacing the sets of clamping flaps and plane cutters.

As seen in FIG. 4, the cutting edges of standard planer cutters 5*c*, designed as reversible cutters and held by guide plates 16, are located on a circle of rotation 21 that is substantially smaller than the rotating circle diameter 22 shown in comparison and upon which the outermost cutting edges of the profile cutters 10 would be located. A recess 31 of the center piece forms the chip ejection groove. It is adapted for this smallest diameter of the circle of rotation.

Figure 5:
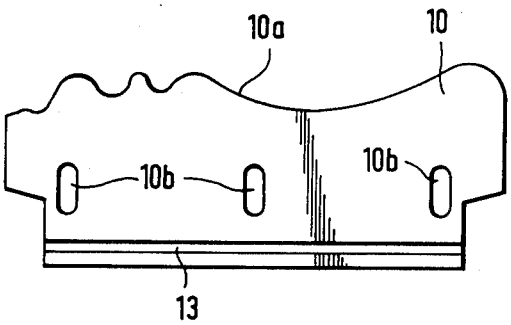
FIG. 5 is an elevational view of the novel profile cutter.

An advantage of the embodiment according to FIG. 3, is that rapid conversion to other types of profile cutters is possible. For this purpose, merely the appropriate profile cutters and new clamping flaps adapted to them are inserted. This advantageous mounting is predicated on the configuration of the profile cutter 10 (FIG. 5) and in particular on the groove 13 located on a side of the orifices 10*b* facing away from the cutting edge 10*a*. In this manner, the adjusting bolts 11 may be made accessible from the side facing away from the cutting edge 10*a*, whereby the alignment and handling of the planing head is appreciably facilitated and improved. The stability of the cutters itself is not weakened in the area of the edge and the adjacent clamped area. The groove 13 has a rectangular cross-section. It may be inserted easily into the cutter 10. The collar 12 of the adjusting screw is thereby given a readily producible configuration.

It will be appreciated that the flaps 5 are each positively connected to the center piece at circumferentially spaced locations, i.e., at one location by the bolt 6, and at another location by the shoulder 3*c*. Thus, the flap 5 can be of longer circumferential dimension than has been heretofore possible. This means that by shaping the outer circumference of the flap complementarily to the shape of the cutter, virtually the entire circumference of the planing tool is adapted to the profile to be formed and fulfills the necessary safety requirements. Furthermore, this feature is achieved by means of cutters 10 and flaps 5 which are replaceable as sets; there is no need to limit each planer tool to the cutting of only one shape. The tool can be quickly and easily adapted to the cutting of different shapes.

The center piece and flaps can be formed in numerous ways, e.g., by the non-cutting deformation (stamping) of light pieces of metal. The steel plate 20 reinforces the flap.

Although the present invention has been described in connection with preferred embodiments thereof, it will be appreciated by those skilled in the art that additions, modifications, substitutions, and deletions may be made without departing from the spirit and scope of the invention as defined in the appended claims.

What is claimed is:

1. A rotary planing tool for use with a plane having a drive means, said rotary planing tool comprising:

a center piece defining an axis of rotation and adapted to be rotatably driven by the drive means, at least two replaceable cutters arranged symmetrically with respect to said axis of rotation, a replaceable clamping flap associated with each said cutter, each flap including a proximate end disposed adjacent a cutting edge of the associated cutter and radially outwardly of such cutter, said flap extending circumferentially to a remote end of said flap disposed adjacent the cutting edge of the next said cutter, each flap including an outer periphery shaped complementarily to the shape of the cutting edge, a mounting bolt associated with each flap for securing such flap to said center piece, said center piece and said remote end of each flap including mutually engaging shoulder means spaced circumferentially from the associated mounting bolt for positively connecting said flap to said center piece, said shoulder means arranged to block removal of said remote end from said center piece in a direction disposed parallel to longitudinal axis of said bolt and in a plane perpendicular to said axis of rotation.

2. A rotary planing tool according to claim 1, wherein said flap carries a steel reinforcing plate.

3. A rotary planing tool according to claim 2, wherein said plate is disposed on a surface of its associated flap which faces the associated cutter.

4. A rotary planing tool according to claim 2, wherein each said plate is molded to its associated flap.

5. A rotary planing tool according to claim 1, wherein an adjusting screw is provided for each said cutter, said adjusting screws being connected to said center piece and to its associated cutter for radially moving the latter in response to rotation of said adjusting screw; said adjusting screws extending perpendicularly to said mounting bolts; each said flap including bores for enabling said adjusting screws to be accessible from the outside.

6. A rotary planing tool according to claim 5, wherein each cutter includes orifice means through which said clamping bolt extends, each cutter including a groove located on a side of said cutter such that said orifice means is situated between said groove and the cutting edge of said cutter, said adjusting screw including a collar which engages said groove.

7. A rotary planing tool according to claim 1, wherein said remote end of each flap is disposed radially inwardly of the associated cutter.

8. A rotary planing tool according to claim 7, wherein said shoulder means on said remote end of said flap extends toward said longitudinal axis of said bolt.

9. A rotary planing tool according to claim 8, wherein said shoulder means on said flap and said center piece each defines a plane disposed perpendicularly to said longitudinal axis of said bolt.

10. A rotary planing tool according to claim 8, wherein said remote end of each flap includes an enlargement which is slidably disposed within a groove of said outer piece, said groove extending parallel to said axis of rotation and constraining said flap for removal solely in a direction parallel to said axis of rotation, said shoulder means of said remote end defining one side of said enlargement.

* * * * *